United States Patent [19]

Sato et al.

[11] Patent Number: 5,017,131

[45] Date of Patent: May 21, 1991

[54] ATMOSPHERE FURNACE

[75] Inventors: Syoji Sato, Neyagawa; Yutaka Makino, Kobe; Kazumi Ishimoto, Katano; Yasuo Izumi, Ikoma, all of Japan

[73] Assignee: Matsushita Electric Industrial Co., Ltd., Osaka, Japan

[21] Appl. No.: 545,891

[22] Filed: Jun. 29, 1990

[30] Foreign Application Priority Data

Jun. 30, 1989 [JP] Japan ..... 1-170146

[51] Int. Cl.[5] ..... F27B 9/04

[52] U.S. Cl. ..... 432/152; 432/128; 432/205; 414/200; 414/217

[58] Field of Search ..... 432/128, 152, 153, 205; 414/207, 217

[56] References Cited

U.S. PATENT DOCUMENTS

| | | | |
|---|---|---|---|
| 3,063,878 | 11/1962 | Wilson | 432/128 |
| 3,982,887 | 9/1976 | Kendziora et al. | 432/128 |
| 4,397,451 | 8/1983 | Kinoshita et al. | 432/128 |
| 4,518,353 | 5/1985 | Banno et al. | 432/152 |
| 4,586,898 | 5/1986 | Orbeck | 432/128 |
| 4,627,814 | 12/1986 | Hatton et al. | 432/128 |
| 4,767,320 | 8/1988 | Sasaki et al. | 432/152 |
| 4,790,749 | 12/1988 | Mauro | 432/152 |
| 4,966,547 | 10/1990 | Okuyama et al. | 432/128 |

*Primary Examiner*—Henry C. Yuen

*Attorney, Agent, or Firm*—Wenderoth, Lind & Ponack

[57] ABSTRACT

An atmosphere furnace including a plurality of divided furnace units, work transfer devices connecting the adjacent divided furnace units and those for the divided furnace units at both ends of the furnace. Each transfer device includes a tubular connecting frame and a work transfer member housed therein and the work transfer member has a work housing space in it. The work transfer member is rotatable, receives at a first position the work from outside or from an adjacent divided furnace unit into its work housing space, and send it out of the furnace or pass it to the adjacent divided furnace unit at a second position. When the work transfer member is at a middle position between the first and the second positions, the work housing space thereof faces an inner surface of the connecting frame so as to be sealed against the both end openings of the frame. Furthermore, it is provided with a channel for receiving the atmosphere from any divided furnace unit or outside space when the transfer member is at the middle position so as to have the work in the work housing space gradually heated or cooled through introduction of the atmosphere.

6 Claims, 4 Drawing Sheets

ATMOSPHERE FURNACE

BACKGROUND OF THE INVENTION

1. Field of the invention

The present invention generally relates to an atmosphere furnace such as a heating furnace, gas furnace and low pressure furnace and more particularly to an atmosphere furnace suitable as a reflow furnace for melting by heating a cream solder for soldering by melting cream solder.

2. Description of the related art

As shown in FIG. 6, a conventional tunnel-like furnace has a housing 31 divided into a plurality of chambers 33 by partitions 32. Each chamber 33 is provided with a heater 34 and a fan 35 for chamberwise temperature control. Through this furnace housing 31 there is provided a conveying means 36 for a work 37. It is so arranged that the work 37 is heated according to a given temperature profile by conveying the work 37 to pass through the individual chambers 33 in the furnace housing 31 successively to thereby melt a cream solder.

In the aforementioned reflow furnace, however, the atmosphere was bound to leak through an opening for work made in the partition 32 between the adjacent chambers 33 into the adjacent chamber or to the outside space, hence it was difficult to accurately control the temperature of each chamber 33 and the thermal efficiency was very poor due to a large heat loss.

Also, in order to do melting, it is preferred to first preheat the work from the normal temperature to approximately 150° C., then heat to not less than 200° C. and keep that temperature for a given length of time and then lower the temperature again to 150° C. or so and after keeping at this temperature for some time to gradually cool to the normal temperature. With the aforementioned reflow furnace, however, the temperature profile is as shown in FIG. 5*c*, and since the maximum temperature is approximately 250° C. in order to keep a temperature of approximately 200° C. for a predetermined length of time, the furnace of this type is good for only works of high heat resistance.

In order to solve these problems it is conceivable to use an atmosphere furnace having therein a plurality of divided furnace units closed from the outside space and individually temperature-controllable and, moreover, a work transfer means which allows transfer of works between adjacent divided furnace units with the atmosphere contained in each unit separate from that in adjacent units as well as shut from the outside space so that each work can be transferred from one divided furnace unit to an adjacent one in order. With this type of atmosphere furnace a high precision temperature control is feasible in the absence of leakage of atmosphere from each divided furnace unit. Moreover the thermal efficiency is high and the temperature in each divided furnace unit can be kept at a given level uniformly, hence a temperature profile as shown in FIG. 5*b* is obtainable, hence the work can be kept at no less than the predetermined temperature for the predetermined length of time without any risk of the work being exposed to a temperature substantially higher than that. Meanwhile, however, there is a problem that, as the work moves from the outside space to a divided furnace unit or from a divided furnace unit to an adjacent one, it is subjected to thermal stress, this causing damage or trouble to the work.

SUMMARY OF THE INVENTION

Accordingly, an essential object of the present invention is to provide an atmosphere furnace with which a high precision control is feasible with a high efficiency and without any risk of damage or trouble due to sudden atmospheric changes.

In accomplishing this object, according to the present invention, there is provided an atmosphere furnace comprising a plurality of divided furnace units different in atmospheric condition and aligned and a plurality of work transfer means are arranged between the adjacent divided furnace units or between the divided furnace units at both ends and the outside space. Each transfer means comprises a tubular connecting frame having inlet and outlet side openings in the adjacent divided furnace units or in the outside space and a transfer member which has formed therein a work housing space having one opening. The transfer member is rotatable with three alternative switching positions, namely a first work transfer position where the housing space opens in the inlet side opening of the connecting frame, a second work transfer position where it opens in the outlet side opening and a middle position amid between the first work transfer position and the second work transfer position where the work housing space is closed facing an inner surface of the connecting frame. It also comprises an atmosphere introducing means which introduces atmosphere of any divided furnace unit or in the outside space into the work housing space of one divided furnace when the transfer unit is at the middle position.

According to the present invention, when the work is transferred from a divided furnace unit to an adjacent one or between the divided furnace units at either end and the outside space, the condition of the atmosphere in the work housing space can gradually approach that of the receiving divided furnace unit or outside space by stopping the transfer unit at the middle position and introducing the atmosphere of the divided furnace unit or outside unit into the work housing space to receive the work next and thereby ensure against the work being damaged or in trouble due to any sudden change of the condition of atmosphere.

Also, by measuring the atmospheric condition in the work housing space when the transfer member is at the middle position, it is possible to do switchover of the position of the transfer member after confirmation of the atmosphere having reached the predetermined condition or vary the atmospheric condition under the optimum state by controlling the atmosphere introducing means.

BRIEF DESCRIPTION OF THE DRAWINGS

This object and feature for the present invention will become apparent from the following description taken in conjunction with the preferred embodiment thereof with reference to the accompanying drawings, in which.

DETAILED DESCRIPTION OF THE INVENTION

Figure 1:
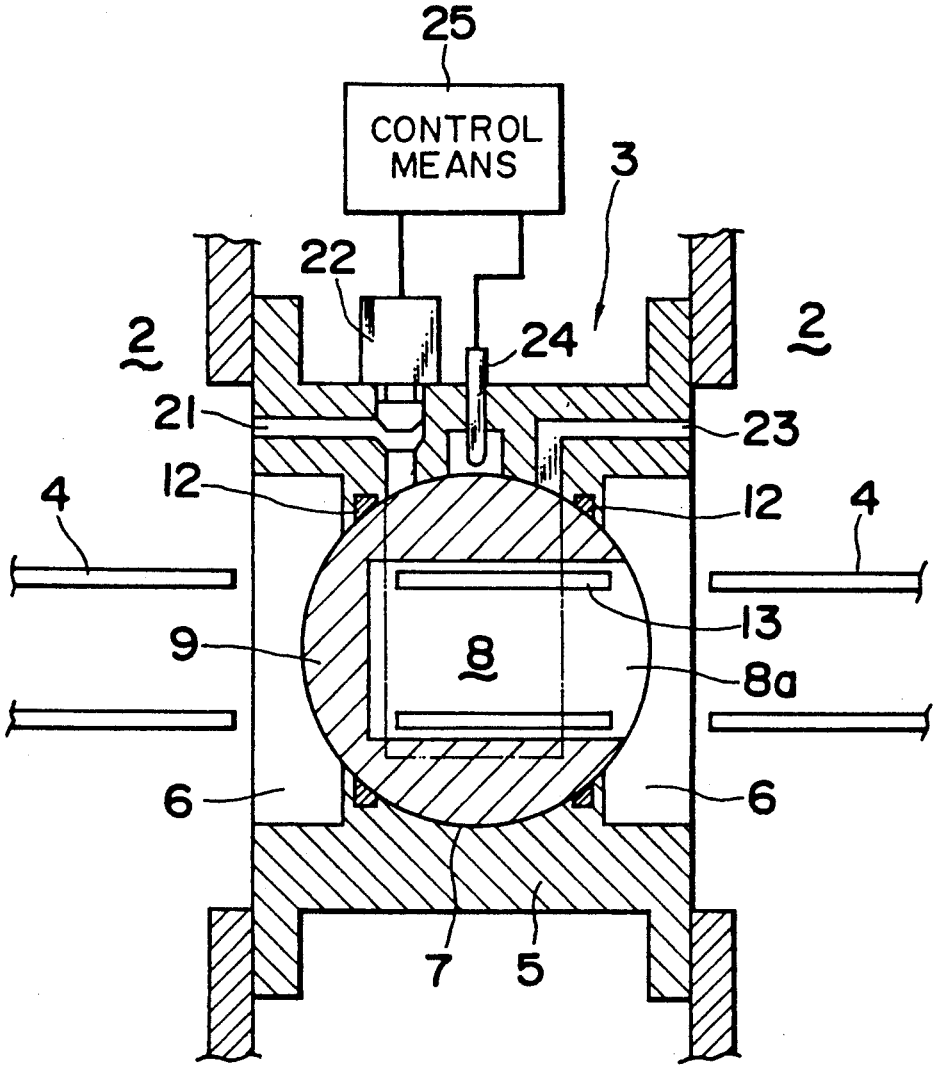
FIG. 1 is a horizontally sectioned plan view of the essential parts of a reflow furnace according to a preferred embodiment of the present invention.

Before the description of the present invention proceeds, it is to be noted that like parts are designated by like reference numerals throughout the accompanying drawings.

Referring to FIGS. 1-4, a preferred embodiment of the present invention as it is applied to a reflow furnace will be described.

Figure 4:
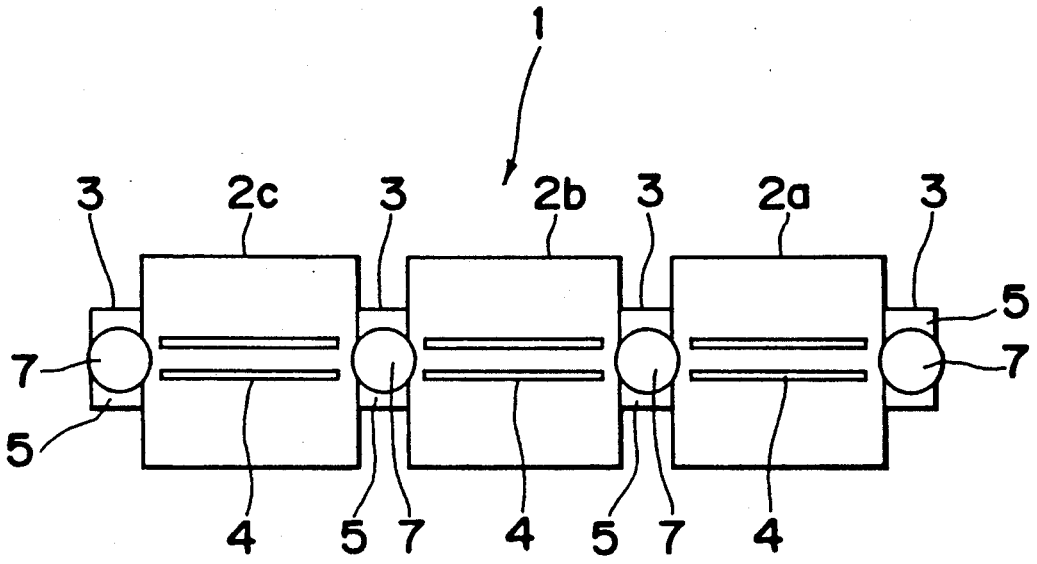
FIG. 4 is a plan view showing the outline composition of the reflow furnace as a whole.
Figure 6:
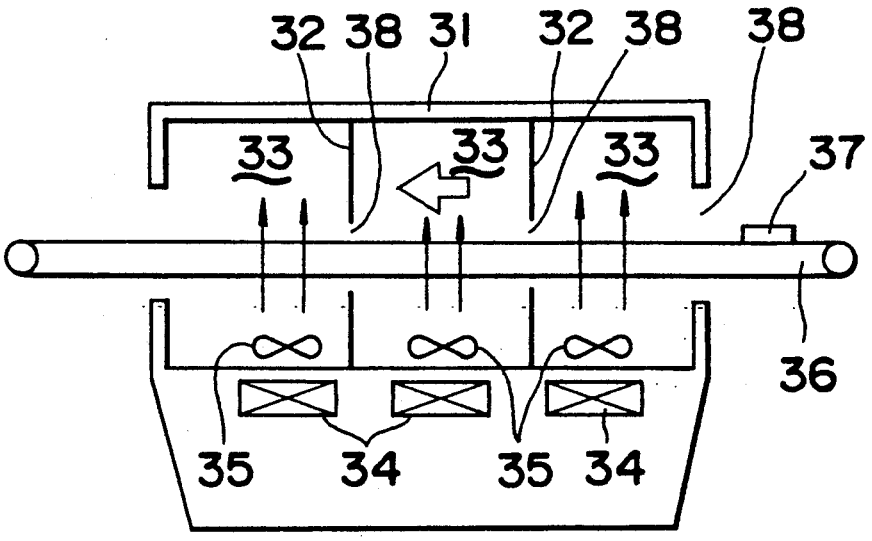
FIG. 6 is a vertically sectioned front elevation showing the outline composition of a conventional reflow furnace.

The composition as a whole of a reflow furnace 1 is as shown in FIG. 4, the furnace comprising a plurality of divided furnace units 2 (three units in the illustrated embodiment) (2a, 2b, 2c) aligned and between the divided furnace units 2a and 2b, 2b and 2c as well as between the divided furnace units at both ends 2a, 2c and the outside space there is provided each one work transfer means 3. In each divided furnace unit 2a-2c there are provided a conveying means 4 for conveying the work from one work transfer means 3 to another as well as a heater and fan (not shown) for controlling the temperature in each divided furnace unit 2a-2c at a predetermined level.

Figure 2:
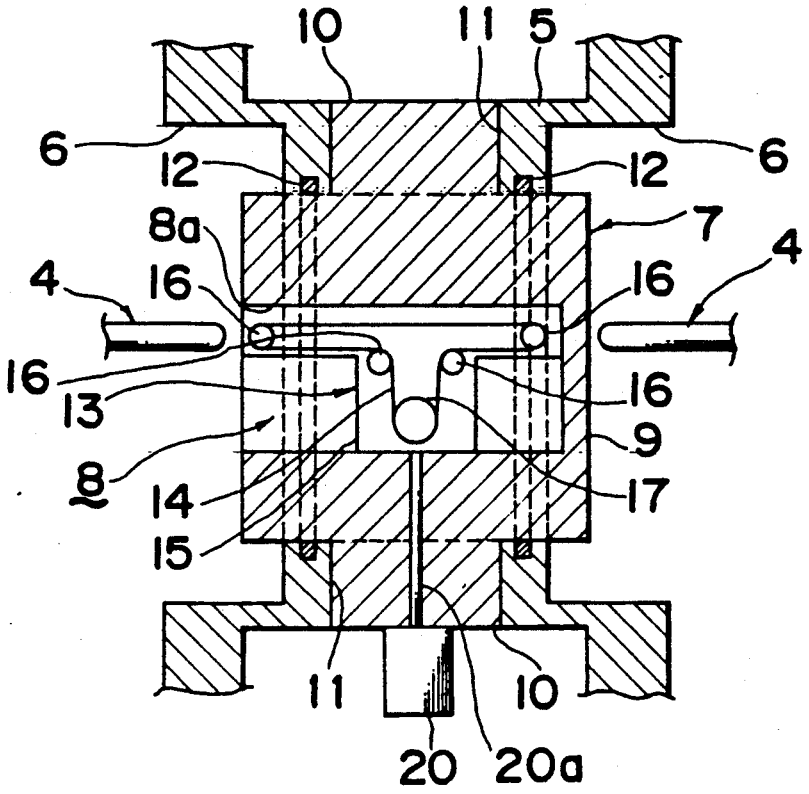
FIGS. 2 and 3 are vertically sectioned front elevations of the same embodiment respectively.
Figure 3:
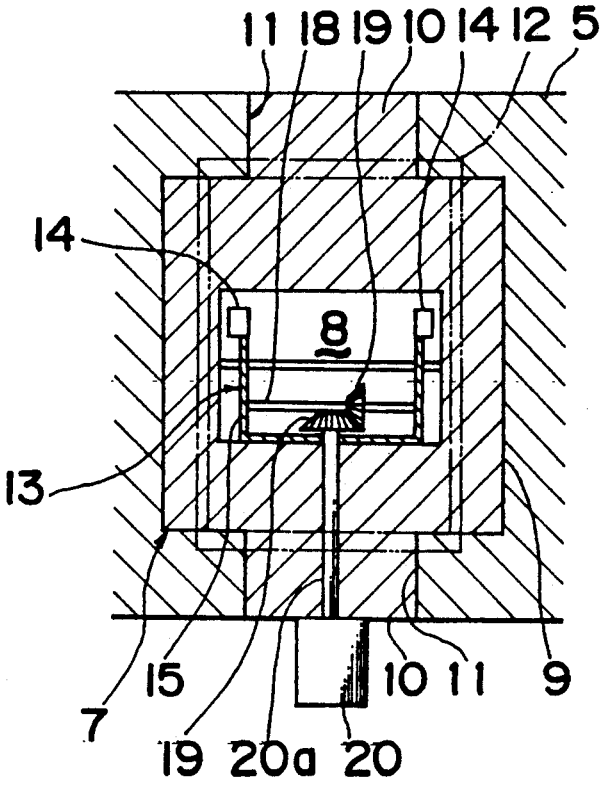

As seen from FIGS. 1-3, the work transfer means 3 includes a tubular connecting frame having openings 6 opening in the divided furnace units 2 or opening in the outside space and a work transfer member 7 arranged in this connecting frame 5 to be rotatable about the vertical axis. The transfer member 7 includes a work housing space 8 open only on one side and an opening 8a of this work housing space 8 has its position switchable between three alternatives, namely a first transfer position in which an opening 8a of this work housing space 8 communicates with either opening 6, a second transfer position in which it communicates with the other opening 6 and a middle position it does not communicate with any of the openings.

The transfer member 7 is, as shown in FIGS. 1-3, composed of a large diameter cylindrical part 9 and small diameter cylindrical part 10 connected to the upper and lower end thereof, namely to form a trunnion shaft, and is rotatably supported by means of a bearing hole 11 formed in the connecting frame 5. The connecting frame 5 has an inner surface between the opposed openings 6 to which the transfer member 7 is slidably contacted. A pair of seal rings 12 are mounted in the opposed end portions of the inner surface of the connecting frame 5 for sealing where they are in sliding contact with the outer peripheral face of the large-diameter cylindrical part 9. The work housing space 8 is provided with a conveying means 13 for letting in or out the work. This conveying means 13 includes a pair of endless chains 14 guided by five sprockets 16, 17 on support frames 15 in the space 8 in T-shape, as viewed in FIG. 2, and the driving sprockets 17 fixed on rotary shafts 18 are driven by a motor 20 with its driving shaft 20a mounted under the transfer member 7 via bevel gears 19 in the forward as well as the reverse sense.

When the transfer member 7 is at the middle position, as shown by the imaginary line in FIG. 1, the opening 8a of the work housing space 8 is between the seal rings 12, 12 so that it is sealed against the openings 6 in both end portions of the connecting frame 5, and is closed to the neighboring divided furnace units 2 or the outside space. And there is provided in the connecting frame 5 an atmosphere introducing channel 21 to let the atmosphere from either adjacent divided furnace unit 2 or from the outside space into the work housing space 8 and a control means 25 for controlling a solenoid valve 22 to open and close the channel 21. Also there is provided an exhaust channel 23 for exhausting the atmosphere in the work housing space 8 into the other divided furnace unit 2 or the outside space. Further provided is a thermometer 24 for measuring the temperature in the work housing space 8 projected into a recess formed in the inner surface of the connecting frame 5. And it is so arranged that the detection signal from the thermometer 24 is inputted to a control means for on-off controlling a driving means (not shown) for positional switchover of the transfer member 7 and for open-close controlling of the solenoid valve 22.

Although in the example shown in FIG. 1, the pressure in the left divided furnace unit 2 is higher than that in the right one and the atmosphere in the left divided furnace unit 2 flows into the work housing space 8 when the atmosphere introducing channel 21 alone is opened. Needless to say, however, if the pressure difference between the divided furnace units 2, 2 is small or there is a reversed pressure difference a forced atmosphere moving means such as a fan may be used.

In the above composition, when the cream solder is melted for soldering, the temperature in the divided furnace units 2a, 2c on the inlet and outlet sides is to be controlled at 150° C. and that in the middle divided furnace unit 2b at 200° C.

In such condition the transfer member 7 of the work transfer means 3 between the inlet side divided furnace unit 2a and the outside space is switched to the first transfer position where it communicates with the inlet side opening 6 on the outside space and the work is let into the work housing space 8 from outside. Then the transfer member 7 is rotary driven and is stopped at the middle position, and by opening the solenoid valve 22 to introduce the atmosphere in the divided furnace unit 2a into the work housing space 8 the atmospheric temperature in the work housing space 8 is raised from the normal level gradually to 150° C. so as to heat the work without subjecting it to any thermal shock. By detecting the then atmospheric temperature in the work housing space 8 with the thermometer 24 to thereby open-close control the solenoid valve 22, it is possible to control the temperature rising rate in the range of 4° C./sec. safe from damage of the work especially when it is, for instance, an electronic part.

When the temperature in the work housing space 8 has risen above the predetermined level, the transfer member 7 is driven to rotate according to the signal outputted by the thermometer 24, the opening 8a of the work housing space 8 is moved to the second transfer position where it communicates with the outlet side opening 6 facing the divided furnace unit 2a and the work is transferred to the conveying means 4 in the divided furnace unit 2a. By this the work is heated in an atmosphere of 150° C. as it passes through the divided furnace unit 2a. Meanwhile, the transfer member 7 rotates back to the first transfer position where the opening 8a of the work housing space 8 communicates with the opening 6 on the outside space side.

The work heated in the divided furnace unit 2a is then sent via the work transfer means 3 between this divided furnace unit 2a and the middle divided furnace unit 2b. In this case, too, same as in the aforementioned case, the transfer member 7 of the work transfer means 3 is stopped at the middle position, the atmosphere in the middle divided furnace unit 2*b* is introduced for the temperature therein to gradually rise to 200° C. before it enters the middle divided furnace unit 2*b*. In the middle divided furnace unit 2*b* the work is heated in an atmosphere of 200° C. and the solder is melted.

Thereafter, the work is gradually cooled as it passes through the divided furnace unit 2*c* on the outlet side in which the atmospheric temperature is controlled at 150° C. and past the work transfer means 3 disposed between this divided furnace unit 2*c* and the outside space is then taken out into the outside space.

Figure 5A:
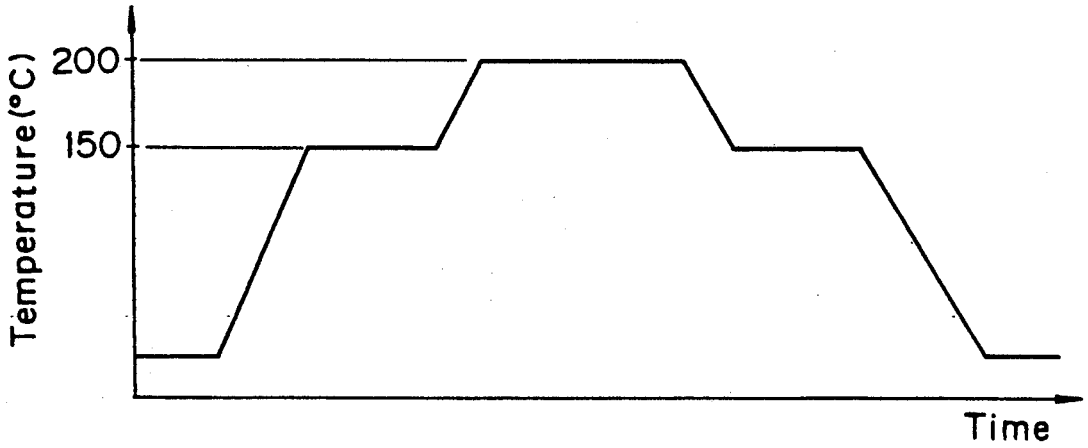
FIGS. 5*a–c* are diagrams showing the temperature profile.
Figure 5B:
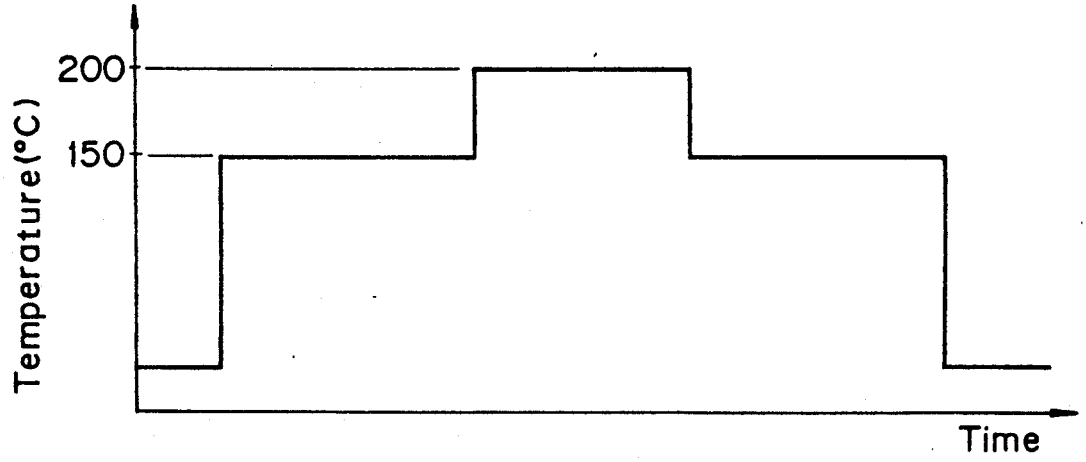
Figure 5C:
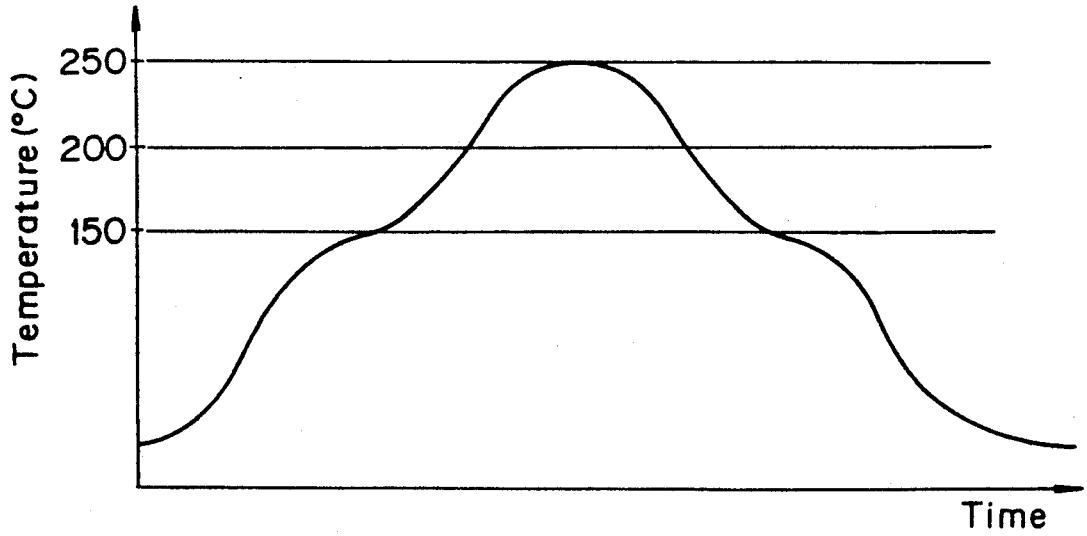

Thus, the work is heated following the temperature profile shown in FIG. 5*a*, melted at 200° C. and then gradually cooled before it is taken out of the furnace.

In the embodiment described above the transfer member 7 used is cylindrical but it may as well be spherical and, further, proper modification is possible with regard to the shape of the connecting frame and the transfer member. The conveying means disposed in the work housing space, too, may not necessary be of the aforementioned type by the use of endless chains and those provided with a cylinder-actuated pushing-out means, pulling-in means etcetera may as well be used.

Although in the above embodiment the present invention is applied to a reflow furnace, it may as well be applicable to a heating furnace, gas furnace, low pressure furnace or the like if as the control object is chosen properly from the temperature, gas concentration, pressure and the like of atmosphere.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. An atmosphere furnace comprising:

a plurality of divided furnace units different in atmospheric conditions and aligned, a plurality of work transfer means arranged between said adjacent divided furnace units or between one of said divided furnace unit on either side and outside space, each transfer means comprising a connecting frame tubular and having on both sides thereof an inlet side and an outlet side openings opening in said adjacent divided furnace unit or the outside space; and a transfer member housed in said connecting frame having formed therein a work housing space with one opening, said transfer member being rotatably housed with three alternative switching positions, namely a first work transfer position where said housing space opens in the inlet side opening of said connecting frame, a second work transfer position where it opens in said outlet side opening of said connecting frame and a middle position amid between said first work transfer position and said second work transfer position where said work housing space is closed facing an inner surface of said connecting frame; and an atmosphere introducing means which introduces atmosphere in any divided furnace unit or in outside space into said work housing space of said one divided furnace when said transfer member is at said middle position.

2. An atmosphere furnace as claimed in claim 1, further comprising a measuring means which measures condition of atmosphere in said work housing space of said transfer member at said middle position.

3. An atmosphere furnace as claimed in claim 1, said work transfer means has in the work housing space thereof a work conveying means for receiving a work from outside space or an adjacent divided furnace unit and passing the work to said adjacent divided furnace unit or the outside space.

4. An atmosphere furnace as claimed in claim 1, wherein said work transfer member is cylindrical.

5. An atmosphere furnace as claimed in claim 1, wherein said work transfer member is spherical.

6. An atmosphere furnace as claimed in claim 1, wherein said atmosphere introducing means is a passage formed inside said connecting frame, one end thereof opening in an adjacent furnace unit or outside space and the other end thereof opening in said inner surface of said work transfer member.

* * * * *